US010276281B1

(12) United States Patent
Cook

(10) Patent No.: US 10,276,281 B1
(45) **Date of Patent: *Apr. 30, 2019**

(54) COMMUNICATION CABLES WITH TWISTED TAPE SEPARATORS

(71) Applicant: Superior Essex International LP, Atlanta, GA (US)

(72) Inventor: Thomas Christopher Cook, Woodstock, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/345,775

(22) Filed: Nov. 8, 2016

(51) Int. Cl.

| | |
|---|---|
| ***H01B 11/04*** | (2006.01) |
| ***H01B 11/08*** | (2006.01) |
| ***H01B 11/06*** | (2006.01) |
| *H01B 7/17* | (2006.01) |
| *H01B 7/282* | (2006.01) |
| *H01B 7/295* | (2006.01) |

(Continued)

(52) U.S. Cl.
CPC ..... *H01B 11/04* (2013.01); *H01B 11/06* (2013.01); *H01B 11/08* (2013.01); *H01B 7/00* (2013.01); *H01B 7/17* (2013.01); *H01B 7/18* (2013.01); *H01B 7/1805* (2013.01); *H01B 7/282* (2013.01); *H01B 7/295* (2013.01); *H01B 9/00* (2013.01); *H01B 11/00* (2013.01); *H01B 11/02* (2013.01); *H01B 13/00* (2013.01)

(58) Field of Classification Search
CPC ..... H01B 11/04; H01B 11/06; H01B 11/08; H01B 7/17; H01B 7/282; H01B 7/295; H01B 7/18; H01B 7/1805
See application file for complete search history.

(56) References Cited

U.S. PATENT DOCUMENTS

| | | | |
|---|---|---|---|
| 1,389,143 | A | 8/1921 | Kempton |
| 2,538,019 | A | 1/1951 | Edwin |

(Continued)

FOREIGN PATENT DOCUMENTS

| | | |
|---|---|---|
| DE | 1632957 | 5/2005 |
| EP | 0915486 | 11/1998 |

(Continued)

OTHER PUBLICATIONS

"Product Calalogue" 2 pages, Enterprise Cabling R&M, May 2006.

(Continued)

*Primary Examiner* — Steven T Sawyer
*Assistant Examiner* — Paresh H Paghadal

(57) ABSTRACT

A cable may include a plurality of twisted pairs of individually insulated conductors and a separator positioned between the twisted pairs. The separator may be formed from a tape that is scored at a plurality of respective spaced locations along a longitudinal direction. As a result of scoring the second portion, a plurality of longitudinally spaced sections extending from the first portion may be defined. The tape may then be twisted along the longitudinal direction such that a first of the plurality of sections extends in a first direction between a first set of adjacent twisted pairs and a second of the plurality of sections extends in a second direction different than the first direction and between a second set of adjacent twisted pairs. A jacket may be formed around the twisted pairs and the separator.

16 Claims, 8 Drawing Sheets

(51) Int. Cl.

| | |
|---|---|
| *H01B 11/02* | (2006.01) |
| *H01B 7/18* | (2006.01) |
| *H01B 7/00* | (2006.01) |
| *H01B 13/00* | (2006.01) |
| *H01B 9/00* | (2006.01) |
| *H01B 11/00* | (2006.01) |

(56) References Cited

U.S. PATENT DOCUMENTS

| | | | | |
|---|---|---|---|---|
| 2,796,463 | A | 6/1957 | Mallindrodt | |
| 3,090,825 | A | 5/1963 | Volk | |
| 3,135,935 | A | 6/1964 | Eugelbrecht | |
| 3,312,774 | A | 4/1967 | Drinko | |
| 3,373,475 | A | 3/1968 | Peterson | |
| 3,612,744 | A | 10/1971 | Thomas | |
| 4,165,442 | A | 8/1979 | Gabriel | |
| 4,604,497 | A | 8/1986 | Bell et al. | |
| 4,638,272 | A | 1/1987 | Ive | |
| 4,746,767 | A | 5/1988 | Gruhn | |
| 4,784,462 | A | 11/1988 | Priaroggia | |
| 4,807,962 | A | 2/1989 | Arroyo | |
| 4,881,642 | A | 11/1989 | Adam | |
| 5,006,806 | A | 4/1991 | Rippingale | |
| 5,008,489 | A | 4/1991 | Weeks et al. | |
| 5,106,175 | A | 4/1992 | Davis et al. | |
| 5,114,517 | A | 5/1992 | Rippingale et al. | |
| 5,177,809 | A | 1/1993 | Zeidler | |
| 5,789,711 | A | 8/1998 | Gaeris | |
| 5,952,615 | A | 9/1999 | Prudhon | |
| 5,956,445 | A | 9/1999 | Deitz et al. | |
| 6,222,130 | B1 | 4/2001 | Gareis | |
| 6,248,954 | B1 | 6/2001 | Clark | |
| 6,288,340 | B1 | 9/2001 | Arnould | |
| 6,297,454 | B1 | 10/2001 | Gareis | |
| 6,310,295 | B1 | 10/2001 | Despard | |
| 6,365,836 | B1 | 4/2002 | Blouin | |
| 6,506,976 | B1 | 1/2003 | Neveux, Jr. | |
| 6,570,095 | B2 | 5/2003 | Clark | |
| 6,596,944 | B1 | 7/2003 | Clark | |
| 6,624,359 | B2 | 9/2003 | Bahlmann | |
| 6,639,152 | B2 | 10/2003 | Glew | |
| 6,687,437 | B1 | 2/2004 | Starnes et al. | |
| 6,723,925 | B2 | 4/2004 | Ohara et al. | |
| 6,737,574 | B2 | 5/2004 | Sylvia et al. | |
| 6,770,819 | B2 | 8/2004 | Patel | |
| 6,800,811 | B1 | 10/2004 | Boucino | |
| 6,812,408 | B2 | 11/2004 | Clark | |
| 6,850,161 | B1 | 2/2005 | Elliot | |
| 6,888,070 | B1 * | 5/2005 | Prescott | H01B 11/08 174/113 C |
| 7,098,405 | B2 | 8/2006 | Glew | |
| 7,173,189 | B1 | 2/2007 | Hazy et al. | |
| 7,179,999 | B2 | 2/2007 | Clark et al. | |
| 7,196,271 | B2 | 3/2007 | Cornibert | |
| 7,329,815 | B2 | 2/2008 | Kenny et al. | |
| 7,332,676 | B2 | 2/2008 | Sparrowhawk | |
| 7,335,837 | B2 | 2/2008 | Pfeiler et al. | |
| 7,834,271 | B2 | 11/2010 | Gromko et al. | |
| 7,923,632 | B2 | 4/2011 | Smith et al. | |
| 8,119,907 | B1 * | 2/2012 | McNutt | H01B 11/1008 174/36 |
| 8,313,346 | B2 | 11/2012 | Sparrowhawk | |
| 8,445,787 | B2 | 5/2013 | Nordin | |
| 8,558,115 | B2 | 10/2013 | Jenner et al. | |
| 9,136,043 | B2 | 9/2015 | Brown | |
| 2003/0111241 | A1 * | 6/2003 | Bahlmann | H01B 11/06 174/367 |
| 2003/0217863 | A1 | 11/2003 | Clark et al. | |
| 2003/0230427 | A1 | 12/2003 | Gareis | |
| 2004/0036503 | A1 | 2/2004 | Clark | |
| 2004/0055781 | A1 | 3/2004 | Cornibert | |
| 2006/0048961 | A1 | 3/2006 | Pfeiler et al. | |
| 2006/0131057 | A1 * | 6/2006 | Lique | H01B 11/06 174/113 R |
| 2007/0037419 | A1 | 2/2007 | Sparrowhawk | |
| 2007/0044995 | A1 * | 3/2007 | Park | H01B 11/06 174/113 C |
| 2007/0193769 | A1 * | 8/2007 | Clark | H01B 11/06 174/113 R |
| 2007/0224495 | A1 | 9/2007 | Gibbons et al. | |
| 2007/0275583 | A1 | 11/2007 | McNutt | |
| 2008/0255435 | A1 | 10/2008 | Al-Ali et al. | |
| 2008/0264670 | A1 | 10/2008 | Glew | |
| 2008/0314636 | A1 | 12/2008 | Ogura | |
| 2009/0173514 | A1 * | 7/2009 | Gareis | H01B 11/06 174/113 R |
| 2010/0096179 | A1 * | 4/2010 | Sparrowhawk | H01B 11/06 174/350 |
| 2011/0147039 | A1 | 6/2011 | Smith et al. | |
| 2013/0008684 | A1 | 1/2013 | Weitzel | |
| 2014/0262425 | A1 * | 9/2014 | Hopkinson | H01B 11/06 174/107 |
| 2015/0318075 | A1 | 11/2015 | Heffner et al. | |

FOREIGN PATENT DOCUMENTS

| | | |
|---|---|---|
| GB | 2432963 | 6/2007 |
| JP | 2000090748 | 3/2000 |
| JP | 2004311120 | 11/2004 |
| JP | 2006173044 | 6/2006 |
| WO | WO2006105166 | 5/2006 |
| WO | WO2011020967 | 2/2011 |

OTHER PUBLICATIONS

"Draka" 12 pages, Draka Comtez, Cable Solutions, Data Cables, Sep. 27, 2006.
"10 Gigabit Ethernet Solutions" 8 pages, R&M Convincing Cabling Solutions.
Wetzikon. "R&M. The Rising Stars in Copper Cabling" 2 pages, Sep. 1, 2005.
"R&M Star Real 10" 2 pages, Mar. 2006.
"Connections29" 36 pages, Sep. 2005.
First Office Action for U.S. Appl. No. 15/227,365, dated Apr. 17, 2017.
Non-Final Office Action for U.S. Appl. No. 15/227,390, dated Aug. 30, 2017.
Notice of Allowance for U.S. Appl. No. 15/455,182, dated Jun. 28, 2017.
Notice of Allowance for U.S. Appl. No. 15/435,685, dated Aug. 10, 2017.
Office Action for U.S. Appl. No. 15/252,775, dated May 30, 2018.
Final Office Action for U.S. Appl. No. 15/435,685, dated Feb. 6, 2018.
Notice of Allowance for U.S. Appl. No. 15/227,365, dated Nov. 14, 2017.
Office Action for U.S. Appl. No. 15/252,775, dated Oct. 31, 2017.
Office Action for U.S. Appl. No. 15/277,390, dated Jan. 17, 2018.
Notice of Allowance for U.S. Appl. No. 15/435,685, dated May 9, 2018.
Non-Final Office Action for U.S. Appl. No. 15/624,832, dated Jun. 19, 2018.
Final Office Action for U.S. Appl. No. 15/624,832, dated Nov. 30, 2018.

* cited by examiner

COMMUNICATION CABLES WITH TWISTED TAPE SEPARATORS

TECHNICAL

Embodiments of the disclosure relate generally to communication cables and, more particularly, to communication cables incorporating separators formed from tape structures that are twisted along a longitudinal direction.

BACKGROUND

A wide variety of different types of cables are utilized to transmit power and/or communications signals. In certain types of cables, it is desirable to provide separation for internal cable components. For example, certain cables make use of multiple twisted pairs of conductors to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and cause an increase in bit rate error. Interlinking typically occurs when two adjacent twisted pairs are pressed together, and interlinking can lead to an increase in crosstalk among the wires of adjacent twisted pairs.

In order to improve crosstalk performance, separators (also referred to as separation fillers, fillers, interior supports, or splines) have been inserted into many conventional cables. These separators serve to separate adjacent twisted pairs and limit or prevent interlinking of the twisted pairs. However, many conventional separator arc often formed as preformed structures, such as preformed cross-fillers, that have relatively limited flexibility and include a longitudinally continuous cross-sectional structure. Other conventional separators are formed from relatively flat tapes that only serve to bisect a cable core and may not provide separation for all of the twisted pairs. In the event that a flat tape is folded into another structure, such as a cross-filler, the resulting separator may be relatively bulky, inflexible, and utilize a relatively large amount of material. Accordingly, there is an opportunity for improved cable structures in which a tape structure may be scored or cut and then longitudinally twisted.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different futures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
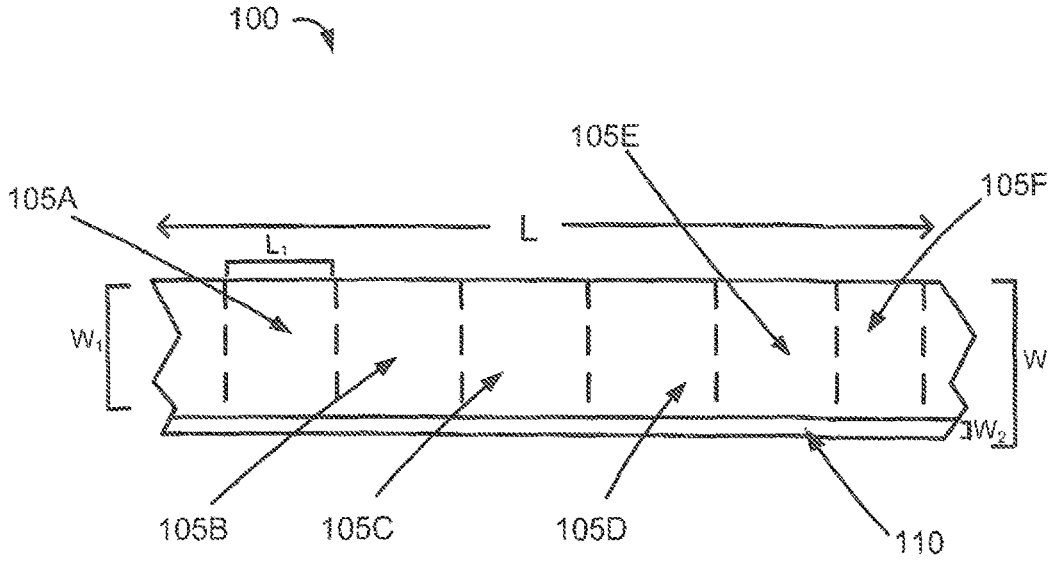
FIG. 1A is a top level view of an example tape structure that may be utilized as a twisted pair separator, according to an illustrative embodiment of the disclosure.

Various embodiments of the present disclosure are directed to twisted pair communication cables that incorporate separators formed from tape structures that are longitudinally twisted. In one example embodiment, a cable may include a plurality of longitudinally extending twisted pairs of individually insulated conductors and a jacket or other suitable layer (e.g., a shield layer, etc.) formed around the plurality of twisted pairs. Additionally, a separator formed from at least one tape structure may be positioned between the plurality of twisted pairs. The tape structure may initially be formed as a relatively flat tape structure or as a tape structure having a substantially uniform thickness along its longitudinal length. The tape structure may be scored or cut at a plurality of spaced locations along its longitudinal direction in order to define a plurality of longitudinally spaced sections that extend from a continuous un scored or uncut section. The tape structure may then be longitudinally twisted such that the plurality of spaced sections extend front the continuous section in a plurality of different directions. Accordingly, when the tape structure is positioned between the plurality of twisted pairs, various spaced sections may extend between different groupings of adjacent twisted pairs. In certain embodiments, the twisted tape separator may function in a similar manner as a conventional cross-filler.

A wide variety of suitable scoring or cutting arrangements may be utilized as desired in various embodiments. In certain embodiments, a continuous portion of a tape structure may be situated proximate to a first longitudinally extending edge of the tape structure, and the tape structure may then be scored from an opposite longitudinally extending edge. In other embodiments, a continuous portion of a tape structure may be positioned along a longitudinal line that is positioned between the two longitudinally extending edges. For example, the continuous portion may extend approximately along a midpoint of the tape structure. The tape structure may then be scored or cut from one or both of its widthwise edges to approximately the continuous portion. In this regard, in certain embodiments, two sections of the tape structure may include a plurality of longitudinally spaced sections.

Additionally, the tape structure may be formed with a wide variety of suitable dimensions. For example, a tape structure may have any suitable longitudinal length, width, and/or thickness. In certain embodiments, a tape structure may have a width that permits one or more of the longitudinally spaced sections to extend from a continuous portion between two adjacent twisted pairs. For example, the width may permit a spaced section to extend up to a distance that corresponds to a radius of a cable core. In other embodiments, a tape structure may have a width that permits one or more longitudinally spaced sections to extend beyond an outer periphery or space occupied by the plurality of twisted pairs. The extending portion of the section(s) may then be wrapped around the outer periphery of the twisted pairs.

A tape structure may be formed from a wide variety of suitable materials and/or combinations of materials. For example, a tape structure may be formed from any suitable combination of dielectric and/or electrical shielding materials (e.g., semi-conductive materials, electrically conductive materials, etc.). In certain embodiments, a tape structure may be formed as a single layer. In other embodiments, a tape structure may include a plurality of layers, such as a combination of dielectric and shielding layers.

A wide variety of suitable scoring or cutting arrangements may also be utilized in conjunction with a tape structure. For example, the tape structure may be scored in order to form longitudinally spaced sections having a wide variety of suitable dimensions, such as longitudinal lengths and/or shapes. In certain embodiments, spaced sections may be formed in accordance with a desired pattern. In other embodiments, spaced sections may be formed in a random or pseudorandom manner. Spaced sections may also be formed with a wide variety of suitable shapes, such as rectangular, parallelogram, approximately triangular, and/or trapezoidal shapes, Additionally, in certain embodiments, a tape structure may be scored in a direction that is approximately perpendicular to its longitudinal direction (e.g., across a widthwise dimension). In other embodiments, a tape structure may be scored at any number of angles relative to its longitudinal direction. Additionally, a wide variety of suitable angles and/or combinations of angles may be utilized to score the tape structure at various locations.

As a result of incorporating scored and longitudinally twisted tape structures into twisted pair cables, desired spacing or separation may be provided between adjacent twisted pairs in order to reduce crosstalk. However, the resulting separator structure may be formed with less overall material than conventional separators, thereby reducing the overall cost of the cable. A twisted tape separator may also provide enhanced flexibility relative to conventional separator structures.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1B:
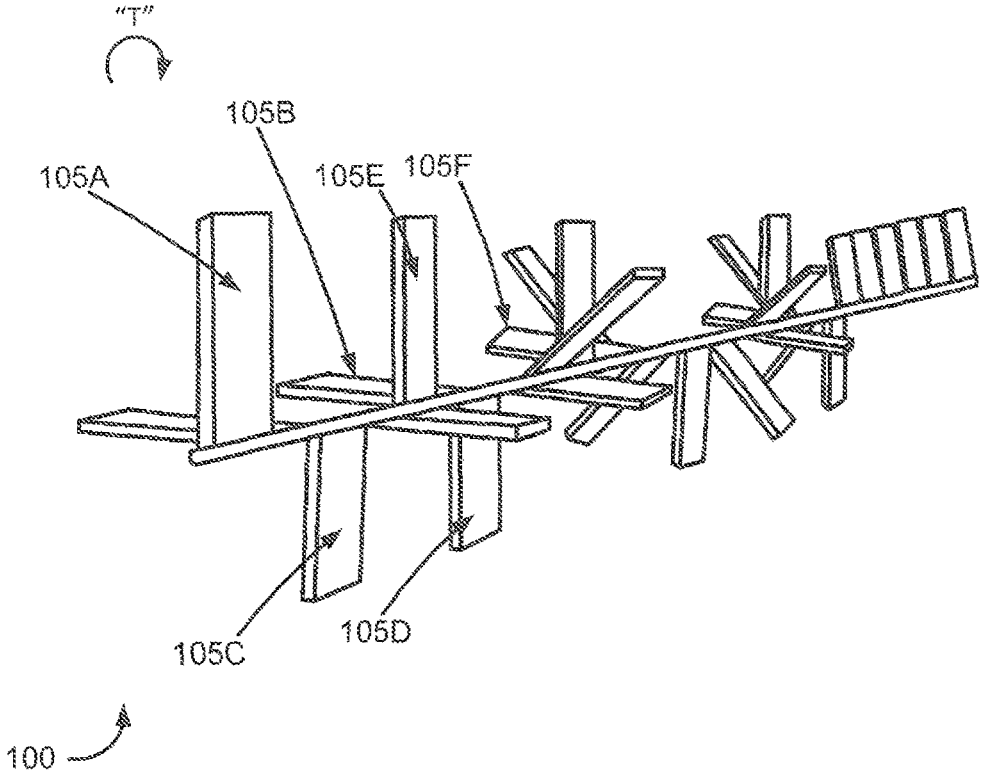
FIG. 1B is a perspective view of the tape structure of FIG. 1A as it is longitudinally twisted in preparation for positioning between a plurality of twisted pairs, according to an illustrative embodiment of the disclosure.
Figure 1C:
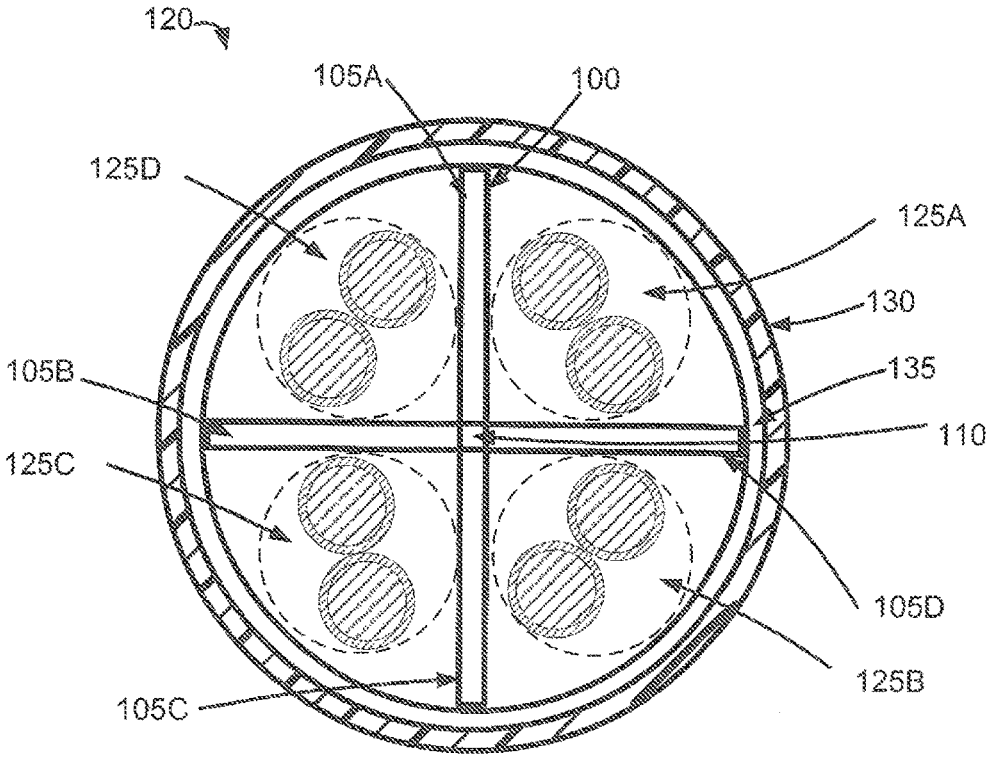
FIGS. 1C and 1D are cross-sectional views of an example twisted pair cables that may incorporate a twisted tape structure, according to illustrative embodiments of the disclosure.
Figure 1D:
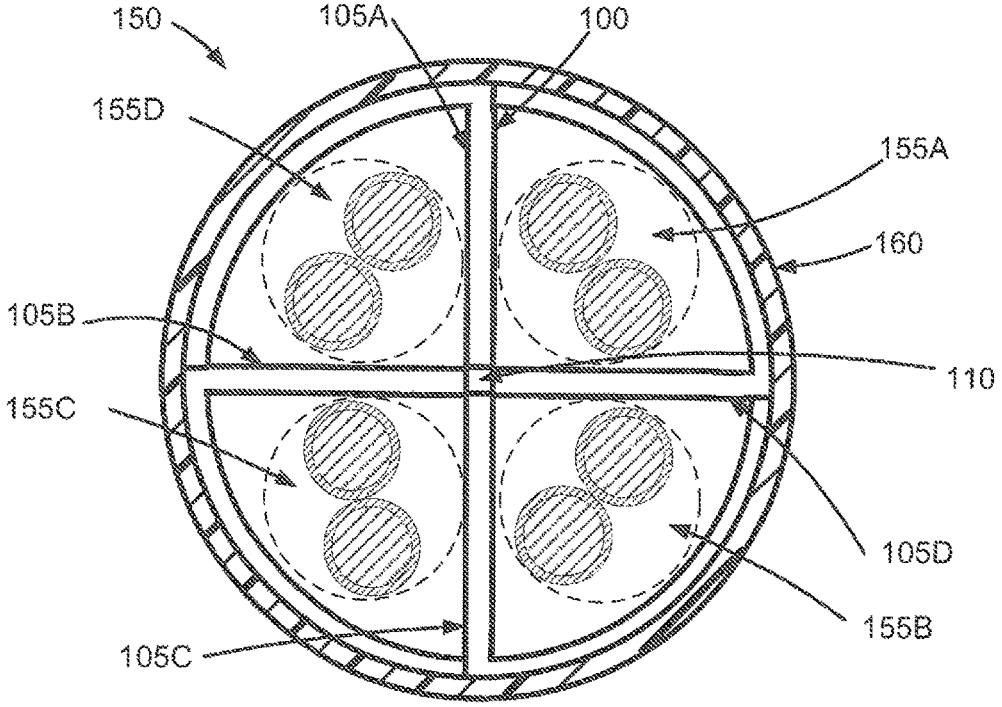

FIGS. 1A and 1B illustrate an example tape structure 100 that may be utilized as a separator in a twisted pair communication cable. FIGS. 1C and 1D then illustrate cross-sectional views of some example cables that may incorporate the tape structure 100 of FIGS. 1A and 1B. It will be appreciated that the tape structure 100 of FIGS. 1A and 1B is provided by way of example only, and a wide variety of other suitable tape structures may be utilized and/or incorporated into cables. Additionally, a tape structure in accordance with an embodiment of the present disclosure may be incorporated into a wide variety of suitable cables.

Turning first to FIG. 1A, a top level view of an example tape structure 100 that may be utilized as a twisted pair separator is illustrated. The tape structure 100 (also referred to as tape 100 or separator 100) may extend along a longitudinal direction "L" that may correspond to a longitudinal dimension of a cable into which the separator 100 is incorporated. The tape 100 may be formed with a wide variety of suitable dimensions, such as any suitable length, width, and/or thickness. In certain embodiments, the tape 100 may be formed as a relatively continuous structure along its longitudinal length. In other words, the tape 100 may have a respective longitudinal length that extends approximately along an entire length of a cable into which the tape 100 is incorporated. In other embodiments, the tape 100 may be formed from a plurality of discrete or severed sections that are arranged adjacent to one another along a longitudinal direction, For example, sections or portions of the tape 100 may be arranged end-to-end along a longitudinal direction, and the combination of sections may function as a single tape. Each section may be formed with any suitable longitudinal length and, as desired in various embodiments, section lengths may be formed in accordance with a pattern or in a random or pseudo-random fashion.

Additionally, the tape 100 may be formed with any suitable width, such as the illustrated width "W". In certain embodiments, the width "W" of the tape 100 may be based at least in part on a desired scoring arrangement and/or a desired purpose of the tape 100 once incorporated into a cable as a separator. For example, as explained in greater detail below, a first portion of the tape 100 may be longitudinally continuous along the length of the tape 100 while at least one other portion of the tape is scored in order to form longitudinally spaced sections. When incorporated into a cable, the longitudinally spaced sections may extend from the longitudinally continuous first portion between various sets of twisted pairs in a cable once the tape 100. As desired, the width "W" of the tape 100 may be determined such that longitudinally spaced sections extend a desired distance from a continuous portion. Additionally, in certain embodiments and as illustrated in FIG. 1D, the width "W" of the tape 100 may be sized such that one or more longitudinally spaced sections extend beyond an outer periphery of a plurality of twisted pairs such that the tape 100 can be wrapped or curled around the outer periphery.

In certain embodiments, the tape 100 may be formed with a width between approximately 3.0 mm and approximately 30.0 mm. For example, a tape 100 may be formed with a width of approximately 3.0 mm, 4.0 mm, 5.0 mm, 6.0 mm, 7.0 mm, 8.0 mm, 9.0 mm, 10.0 mm, 12.0 mm, 15.0 mm, 17.0 mm, 20.0 mm, 22.0 mm, 25.0 mm, 27.0 mm, 30.0 mm, a width included in a range between any two of the previous values, or a width included in a range bounded on either a minimum or maximum end by one of the previous values. Additionally, in certain embodiments, the width of the tape 100 may be relatively continuous along its longitudinal length. In other embodiments, the width of the tape 100 may vary along its longitudinal length. For example, a tape 100 may be formed such that certain longitudinally spaced sections extend farther from a continuous portion than other spaced sections. As desired, prongs or extensions may have any suitable lengths and a wide variety of suitable gap distances may be utilizes. Indeed, a wide variety of different width dimensions and/or configurations may be utilized as desired.

The tape 100 may also be formed with any suitable thickness. Further, in the event that the tape 100 is formed from a plurality of layers (e.g., a dielectric layer and a shielding layer), each layer may have any suitable thickness. In certain embodiments, the tape 100 may be formed with a thickness between approximately 50 μm and approximately 100 μm. For example, the tape 100 may be formed with a thickness of approximately 50 μm, 60 μm, 70 μm, 80 μm, 90 μm, 100 μm, a thickness included in a range between any two of the previous values, or a thickness included in a range bounded on either a minimum or maximum end by one of the previous values. Further, in certain embodiments, the thickness of the tape 100 may vary along one or more other dimensions, such as along a width dimension. For example, a longitudinally continuous portion may be formed with a different thickness than a portion of the tape 100 that is scored in order to form longitudinally spaced sections. As another example, a portion that is utilized to form longitudinally spaced sections may have a varying thickness (e.g., a different thickness for an area that is positioned between twisted pairs and an area that is wrapped around an outer periphery of the twisted pairs, etc.). Indeed, a wide variety of different thicknesses and/or thickness configurations may be utilized as desired.

According to an aspect of the disclosure, the tape 100 may be scored or cut at a plurality of spaced locations along the longitudinal direction in order to define a plurality of longitudinally spaced sections, such as sections 105A-F, that extend from a continuous unscored or uncut section 110. The tape 100 may then be longitudinally twisted as illustrated in FIG. 1B such that the plurality of spaced sections 105A-F extend from the continuous section 110 in a plurality of different directions. Accordingly, when the tape 100 is positioned between a plurality of twisted pairs, various spaced sections may extend between different groupings of adjacent twisted pairs.

A wide variety of suitable scoring or cutting arrangements may be utilized as desired in various embodiments. In certain embodiments, as illustrated in FIG. 1A, a continuous portion 110 of the tape 100 may be situated proximate to a first longitudinally extending edge of the tape 100. and the tape 100 may then be scored from an opposite longitudinally extending edge to the continuous portion 110. In other embodiments, as described in greater detail below with reference to FIGS. 2B and 2C, a continuous portion of a tape structure may be positioned along a longitudinal line that is positioned between the two longitudinally extending edges. For example, the continuous portion may extend approximately along a midpoint of a tape. The tape may then be scored or cut from one or both of its widthwise edges to approximately the continuous portion. In this regard, in certain embodiments, two sections of the tape structure may include a plurality of longitudinally spaced sections.

Each portion of the tape 100 may have a wide variety of suitable dimensions, For example, the scored portion of the tape that is utilized to form longitudinally spaced sections 105A-F may have any suitable width "$W_1$", thickness, and/or other dimensions. Similarly, the continuous portion 110 may have any suitable width "$W_2$", thickness, and/or other dimensions. As set forth above, one or more dimensions may be variable in certain embodiments. For example, a width and/or thickness of a portion of the tape 100 may vary along a longitudinal direction. As another example, a thickness of a portion of the tape 100 may vary along a width dimension.

In certain embodiments, one or more techniques may be utilized to provide additional structural support for the continuous portion 110. For example, one or more strength members (e.g., strength yarns, etc.) may be positioned within the continuous portion 110 (e.g., adhered to a continuous portion, positioned between two layers of the continuous portion 110, etc.). As another example, the continuous portion 110 may be formed with a greater relative thickness in order to enhance its structural integrity. A few examples of tapes that include enhanced continuous portions 110 are described in greater detail below with reference to FIGS. 2A and 2C. As a result of providing additional structural support for the continuous portion 110, the likelihood of the continuous portion being torn, severed, ripped, or otherwise damaged as a result of scoring, twisting, and/or otherwise processing the tape 100 may be reduced.

A wide variety of suitable methods and/or techniques may be utilized to score or cut the tape 100 as desired in various embodiments. For example, the tape 100 may be scored via one or more suitable mechanical cutting devices, such as knives and/or cutting blades. As another example, one or more suitable punches may be utilized to selectively score or cut the tape 100 in order to define longitudinally spaced sections. As yet another example, one or more suitable lasers may be utilized to score or cut the tape 100. As yet another example, the tape 100 may be scored via chemical etching and/or a wide variety of other suitable techniques and/or combinations of techniques. In certain embodiments, scoring or cuts may be made completely through the tape 100. In other embodiments, scorings or cuts may be made partially through the tape 100; however, adjacent longitudinally spaced sections may still separate from one another when the tape 100 is subsequently twisted or otherwise processed. Similarly, in certain embodiments, a continuous line may be scored or cut between adjacent sections. In other embodiments, a plurality of line segments may be scored or cut between adjacent sections; however, the sections may separate from one another when the tape 100 is subsequently twisted or otherwise processed.

A wide variety of suitable scoring or cutting arrangements may also be utilized in conjunction with the tape 100. For example, the tape 100 may be scored in order to form longitudinally spaced sections 105A-F having a wide variety of suitable dimensions, such as a wide variety of suitable longitudinal lengths and/or shapes. Each spaced section (generally referred to as section 105) may have any suitable length, such as the illustrated length "$L_1$" shown in FIG. 1A. In various embodiments, a segment 105 can have a length of about 0.025, 0.05, 0.075, 0.1, 0.2, 0.25, 0.3, 0.4, 0.5, 0.6. 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values. Additionally, in certain embodiments, each of the spaced sections 105A-F may have a longitudinal length that is approximately equal. In other embodiments, at least two of the spaced sections 105A-F may have different longitudinal lengths.

The longitudinally spaced sections 105A-F may also be formed with a wide variety of suitable shapes. As shown in FIG. 1A, each spaced section 105 may be formed with a rectangular or approximately rectangular shape. In other embodiments, a section 105 may be formed with a parallelogram, approximately triangular, or trapezoidal shape.

Additionally, in certain embodiments, each of the spaced sections 105A-F may be formed with approximately the same shape. In other embodiments, at least two sections may be formed with different shapes. For example, adjacent sections may be formed with inverted shapes, such as trapezoidal shapes that alternate directions (i.e., longer base closer to the continuous section 110 followed by shorter base closer to the continuous section 110, etc.). As another example, various sections may be formed with different types of shapes. Indeed, a wide variety pf different shape configurations and/or combinations may be utilized as desired. A few example shape configurations are described in greater detail below with reference to FIGS. 3A-3E.

Additionally, as desired in various embodiments, the tape 100 may be scored in a wide variety of suitable directions and/or combinations of directions. As shown in FIGS. 1A and 1B, the tape 100 may be scored in a direction that is approximately perpendicular to its longitudinal direction (e.g., across a widthwise dimension). In this regard, longitudinally spaced sections 105A-F having approximately rectangular shapes may be formed. In other embodiments, the tape 100 may be scored at any number of other angles relative to its longitudinal direction. For example, the tape 100 may be scored at acute angles at various spaced locations ill order to form longitudinal sections having parallelogram shapes. As another example, scorings may be formed with a combination of angles to form spaced sections having approximately triangular or trapezoidal shapes. Indeed, a wide variety of suitable angles and/or combinations of angles may be utilized to score the tape 100 at various locations. Additionally, in certain embodiments, one or more scoring lines may be formed as straight lines. In other embodiments, one or more scoring lines may be formed as curved or arcuate lines. In yet other embodiments, a combination of straight and curved lines may be utilized in order to score the tape 100.

In certain embodiments, spaced sections 105A-D may be formed in accordance with a desired pattern. For example, each of the spaced sections 105A-D may be formed with approximately the same longitudinal length and/or shape. As another example, spaced sections 105A-D may be formed with different lengths and/or shapes; however, the sections 105A-D may be formed in accordance with a repeating pattern along the longitudinal length of the tape 100. In other embodiments, spaced sections 105A-D may be formed in a random or pseudorandom manner. A wide variety of different patterns and/or scoring arrangements may be utilized as desired in various embodiments. A few non-limiting examples of scoring arrangements that may result in different configurations of longitudinally spaced sections are described in greater detail below with reference to FIGS. 3A-3E.

The tape 100 may be formed from a wide variety of suitable materials and/or combinations of materials. For example, the tape 100 may be formed from any suitable dielectric, and/or shielding materials. In certain embodiments, the tape 100 may be formed from a single layer of material, such as layer of dielectric material or a layer of shielding material (e.g., a metallic foil, a semi-conductive material, etc.). In other embodiments, the tape 100 may be formed with a plurality of layers of material. For example, the tape 100 may be formed with one or more dielectric layers and one or more layers of shielding material. In certain embodiments, the tape 100 may include a base dielectric layer and at least one layer of shielding material may be formed on, attached to, or otherwise associated with the base dielectric layer. In other embodiments, the tape 100 may be formed in accordance with a wide variety of other suitable constructions that include any number of layers. A few example constructions and/or layer configurations that may be utilized to form a tape 100 are described in greater detail below with reference to FIGS. 4A-4E.

A dielectric layer incorporated into the tape 100 may be formed from or formed substantially from one or more dielectric materials. A wide variety of suitable dielectric materials may be utilized including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized. Indeed, a dielectric layer may be filled, unfilled, foamed, un-foamed, homogeneous, or inhomogeneous and may or may not include one or more additives (e.g., flame retardant and/or smoke suppressant materials). Additionally, as set forth above, a dielectric layer may be formed with a wide variety of suitable thicknesses.

In the event that one or more shielding layers are incorporated into the tape 100, each shielding layer may be formed from a wide variety of suitable shielding materials and/or with a wide variety of suitable dimensions. In certain embodiments, a shielding layer may be formed as a relatively continuous layer that includes shielding material extending substantially along a longitudinal length of the tape 100. As desired, once the tape 100 is scored or cut, the shielding material may be severed in order to firm a plurality of discontinuous patches of shielding material. In other embodiments, a shielding layer may be formed as a discontinuous layer having a plurality of isolated patches of shielding material. For example, a plurality of patches, of shielding material may be incorporated into a shielding layer, and gaps or spaces may be positioned between adjacent patches at locations that will be scored or cut. Regardless of whether a continuous or discontinuous shielding layer is, incorporated into the tape 100, in certain embodiments, a plurality of discontinuous patches of shielding material may be formed by the time that the tape 100 is scored and subsequently twisted. With discontinuous patches, the individual patches may be separated from one another so that each patch is electrically isolated from the other patches. That is, the respective physical separations between the patches may impede the flow of electricity between adjacent patches.

A wide variety of suitable materials and/or combination of materials may be utilized to form a shielding layer and/or patches of shielding material. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

Additionally, a shielding layer and/or associated shielding material may be incorporated into the tape 100 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together to form a tape 100. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the shielding material can be over-coated with a dielectric layer or electrically insulating film, such as a polyester coating. In other embodiments, shielding material may be embedded into a base layer or dielectric layer. In yet other embodiments, a tape may be formed (e.g., extruded, etc.) from a shielding material.

Additionally, a shielding layer and/or various patches of shielding material included in a shielding layer may have a wide variety of suitable dimensions. For example, shielding material may have any desired thickness, such as a thickness of about 0.5 mils (about 13 microns) or greater. In many applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils.

In certain embodiments, a shielding layer may include shielding material or patches of shielding material that extend substantially across a width dimension of a tape 100 or substantially across a width "$W_1$" of a second portion of the tape 100 used to form longitudinally spaced portions 105A-F. In other embodiments, shielding material may be formed with a width that is different than the width of an underlying base layer or portion of the base layer. For example, shielding material may extend partially across a width of a base dielectric layer or partially across a width "$W_1$" of a second portion. In other embodiments, the width of shielding material may be determined based at least in part upon a desired shielding function, For example, shielding material may be formed with a width such that it is only positioned between two twisted pairs when the tape 100 is incorporated into a cable. As another example, shielding material may be formed with a width such that it is only positioned on a portion of a tape 100 that is wrapped around an outer circumference or periphery of the twisted pairs. In yet other embodiments, a plurality of discontinuous patches of shielding material may be formed across or within a widthwise dimension, and widthwise gaps may be present between each of the plurality of patches. In yet other embodiments, shielding material may be formed on opposite sides of a base dielectric layer, and the respective shielding material, may have similar widths or different widths, For example, the shielding material formed on a first side of the dielectric layer may be positioned on a first widthwise portion of the tape 100 (or portion of the tape 100) while the shielding material formed on the opposite side of the dielectric layer may be positioned on a different widthwise portion of the tape 100 (or portion of the tape 100). Indeed, any section or patch of shielding material may have any suitable width and a wide variety of different configurations of shielding material may be formed in a widthwise dimension.

As set forth above, a shielding layer may include a plurality of discontinuous patches of shielding material. In certain embodiments, the discontinuities between adjacent patches may be formed as a function of scoring or cutting the tape 100. In other embodiments, other gaps or spaces may be formed between adjacent patches. For example, gaps may be formed between adjacent patches, and the tape 100 may then be scored or cut within one or more of the gaps. As another example, multiple patches may be formed on one or more of the longitudinally spaced sections 105A-F with gaps between adjacent sections. Indeed, a wide variety of different techniques and/or combinations of techniques may be utilized to form discontinuities between various patches. Additionally, each of the patches of shielding material may be formed with a wide variety of suitable patch lengths (e.g., lengths along a longitudinal direction of the tape 100). As desired, the dimensions of the patches can be selected to provide electromagnetic shielding over a specific band of electromagnetic frequencies or above or below a designated frequency threshold. In certain embodiments, each patch may have a length of about 0.05, 0.1, 0.2, 0.25, 0.3, 0.4, 0.5, 0.6, 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values. Additionally, a wide variety of suitable gap distances or isolation gaps may be provided between adjacent patches. For example, the isolation spaces can have a length of about 0.5, 1.0, 1,5, 2.0, 2.5, 3.0, 3.5, 4, 5, 6, 7, 8, 9, or 10 mm, a length included in a range between any two of the above values, or a length included in a range bounded on either a minimum or maximum end by one of the above values.

As desired, the patches may have a wide variety of different shapes and/or orientations. For example, the patches may have a rectangular, trapezoidal, approximately triangular, or parallelogram shape. In certain embodiments, patch shapes may correspond to the shapes of the longitudinally spaced sections 105A-F on which the patches are formed. In other embodiments, patches may have different shapes than the sections 105A-F on which they are formed. In certain embodiments patches may be fanned to be approximately perpendicular (e.g., square or rectangular segment and/or patches) to the longitudinal axis of twisted pairs incorporated into a cable (e.g., pairs adjacent to the tape 100, etc.). In other embodiments, the patches may have a spiral direction that is opposite the twist direction of one or more pairs. That is, if the twisted pair(s) are twisted in a clockwise direction, then the segments and/or patches may spiral in a counterclockwise direction. If the twisted pair(s) arc twisted in a counterclockwise direction, then the conductive patches ma spiral in a clockwise direction. Thus, twisted pair lay opposes the direction of the patch spiral. In certain embodiments, the opposite directions may provide an enhanced level of shielding performance. hi other embodiments, patches may have a spiral direction that is the same as the twist direction of one or more pairs.

Additionally, in certain embodiments, a wide variety of different sections and/or patches of shielding material may be formed with different dimensions. In certain embodiments, different sections of shielding material may be formed with different thicknesses. For example, first shielding material formed on a section of a tape to be positioned between twisted pairs when a separator is formed may have a first thickness while second shielding material funned on a section of the tape to be wrapped around an outer circumference of the twisted pairs may have a second thickness different than the first thickness. Similarly, different types of shielding material and/or different configurations of shielding material (e.g., different patch configurations, etc.) may be formed in different sections of a tape 100. In certain embodiments, different shielding thicknesses, materials, and/or configurations may be selected in order to achieve desired shielding functions for various portions of a tape 100 or separator structure.

According to an aspect of the disclosure, the tape 100 may be formed as a relatively flexible tape that may be longitudinally twisted. In certain embodiments, the tape 100 may be formed as a relatively flat or even as a substantially flat tape having a uniform thickness. In other embodiments, the thickness of the tape may vary in certain embodiments (e.g., along a widthwise dimension); however, the tape 100 may still be relatively flat and/or flexible. In other words, regardless of the dimensions of the tape 100, the tape 100 may be viewed as occupying a single plane prior to being twisted. In the even that an untwisted tape 100 were positioned in a cable, the tape 100 may bisect a cable core or otherwise extend through a single plane. According to an aspect of the disclosure and as shown in FIG. 1B, the tape 100 may be twisted along its longitudinal direction either before and/or during positioning of the tape 100 between a plurality of twisted pairs and/or other cable components. As a result of longitudinally twisting the tape 100, the longitudinally spaced sections 105A-F may extend from the continuous portion 110 in a plurality of different directions. In other words, over the longitudinal length of the tape 100, various sections 105A-F or portions of the tape 100 may extend between different adjacent sets of twisted pairs. Accordingly, in certain embodiments, a relatively flat tape 100 may function as a cross-filler between a plurality of twisted pairs.

A wide variety of suitable methods and/or techniques may be utilized to twist the tape 100 as desired in various embodiments. In certain embodiments, the tape 100 may be fed from one or more suitable sources (e.g., reels, spools, etc.) and connected downstream to one or more suitable twisting devices and/or machines that impart a twist on the tape 100 while back tension is supplied by the source(s) and/or any number of intermediary devices. The tape 100 may be twisted in a suitable direction "T", such as a clockwise or a counter-clockwise direction, as desired in various embodiments. Additionally, the tape 100 may be longitudinally twisted with any desired twist rate and/or twist lay. For example, the tape 100 may be twisted at a rate of between approximately 1.0° and approximately 45.0° per length "$L_1$" when providing four fin separation (e.g., a tape 100 includes spaced sections on one side of a continuous portion 110). As another example, the tape 100 may be twisted at a rate between approximately 1.0° and approximately 90.0° per length "$L_1$" when providing two fin separation (e.g., a tape 100 includes spaced sections on opposite side of a continuous portion 110). In various embodiments, the tape 100 may be twisted at a rale of approximately 1, 5, 10, 15, 20, 25, 30, 35, 40, 45, 50, 55, 60, 65, 70, 75, 80, 85, or 90 degrees, a rate incorporated into a range between any two of the above values, or a rate incorporated into a range bounded on cither a minimum or maximum end by one of the above values. As another example, the tape 100 may be twisted to have a twist lay or twist length between approximately two times "$L_1$" and approximately four times "$L_1$". For example, a tape 100 may have a twist lay of approximately 0.05, 0.075, 0.1, 0.15, 0.2, 0.3, 0.4, 0.5, 0.75, 1.0, 1.5, 2.0, 2.5, 3.0, 3.5, 4.0, 4.5, 5.0, 6.0, 7.0, 8.0, 9.0, or 10.0 meters, a lay incorporated into a range between any two of the above values, or a lay incorporated into a range bounded on either a minimum or maximum end by one of the above values. In certain embodiments, the twist rate and/or twist lay may be based at least in part upon the longitudinal lengths and/or configuration of the longitudinally spaced sections 105A-F. In other words, the twist rate and/or lay may be determined such that various longitudinally spaced sections 105A-F extend from the continuous portion 110 in desired directions or at desired angles.

Once the tape 100 is longitudinally twisted, the various longitudinally spaced sections 105A-F may extend from the continuous portion 110 in a wide variety of suitable directions and/or a wide variety of suitable angles. In certain embodiments, various sections may extend at different angles such that respective sections are positioned between different sets of adjacent twisted pairs. For example, relative to a given stalling point, various sections may extend at approximately a 0 degree, 90 degree, 180 degree, or 270 degree angle. In other words, various sections 105A-F may extend approximately in four different directions such that respective sections extend between each of the four sets of adjacent twisted pairs. Although approximately ninety degree angles are described above, it will be appreciate that longitudinally spaced sections 105A-F may extend at a wide variety of other angles so long as various sections 105A-F arc positioned between desired sets of twisted pairs. Indeed, the process of positioning twisted pairs in proximity to the tape 100 and optionally stranding or helically twisting the tape 100 and twisted pairs together may function to hold the various sections 105A-F in place between the sets of twisted pairs. Accordingly, certain angles of extension may deviate from right angle directions so long as the spaced sections 105A-F may be properly positioned. The description of right angle directions is provided by way of non-limiting example only in order to facilitate understanding.

In certain embodiments, as shown in FIGS. 1A and 1B, a continuous portion 110 of the tape 100 may be positioned at or near a longitudinally extending widthwise edge of the tape 100. Accordingly, when the tape 100 is scored, various longitudinally extending sections may extend in four different directions from the continuous portion 110. For example, as shown in FIG. 1B, a first section 105A may extend in a first direction, a second section 105B may extend in a second directions a third section 105C may extend in a third direction, and a fourth section 105D may extend in a fourth direction. This pattern may be repeated as the tape 100 is twisted in its longitudinal direction. Indeed, FIG. 1B illustrates a tape 100 that is in the process of being twisted. Certain sections are properly oriented, other sections are in the process of being oriented, and yet other sections remain in their original orientation (e.g., have not yet been twisted, etc.).

Figure 2A:
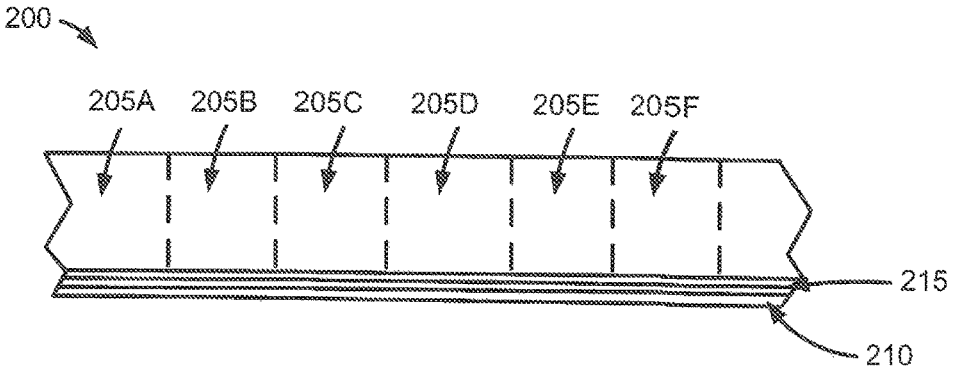
FIGS. 2A-2C are top level view of alternative example tape structures that may be utilized as twisted pair separators, according to illustrative embodiments of the disclosure.

In other embodiments, as described in greater detail below with reference to FIGS. 2B and 2C, a continuous portion 110 may be positioned between the widthwise edges of the tape 100. for example, approximately along a longitudinally extending midpoint line. In this regard, two sets of spaced sections may extend from either side of the continuous portion 110. As the tape 100 is twisted, each of the longitudinally spaced sections incorporated into each set may respectively extend from the continuous portion in any desired direction. For example, a first section included in the first set may extend at an approximately 0 degree direction while a first section included in the second set may extend at an approximately 180 degree direction. A second section in the first set may then extend at an approximately 90 degree direction while a second section in the second set may extend at an approximately 270 degree direction. In other words, once twisted the tape 100 may alternate between bisecting a cable core in a first direction and in a second direction that is approximately perpendicular to the first direction. In other example embodiments, various sections in each set may extend in different directions. Indeed, depending on the scoring configuration and twist rate, a wide variety of suitable separator configurations may be formed as desired.

The tape 100 may be incorporated into a wide variety of twisted pair cables, twisted pair cores (e.g., unjacketed twisted pair groupings, etc.), and/or twisted pair components. In other words, the tape 100 may be positioned between a plurality of twisted pairs incorporated into a cable or cable component. The tape 100 may function to Orient the twisted pairs and/or maintain the relative positions of the twisted pairs, Additionally, in certain, embodiments, the tape 100 may provide electromagnetic shielding for one or more of the twisted pairs. FIGS. 1C and 1D illustrate cross-sectional views of example cables that incorporate a twisted tape structure as a separator in accordance with various embodiments of the disclosure. The cables of FIGS. 1C and 1D are illustrated as a twisted pair communications cables; however, other types of cables may be utilized, such as composite or hybrid cables that include a combination of twisted pairs and other transmission media (e.g., optical fibers, etc.). Indeed, suitable cables may include any number of transmission media including, but not limited to one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables.

Turning to FIG. 1C, a first example cable 120 is illustrated. As shown, the cable 120 may include a plurality of twisted pairs, such as the illustrated four twisted pairs 125A, 125B, 125C, 125D, and the longitudinally twisted tape 100 may be positioned as a separator between the plurality of twisted pairs 125A-D. An outer jacket 130 may then be formed around the twisted pairs 125A-D and the tape 100. In certain embodiments, one or more suitable shield layers, such as an external shield 130 may also be incorporated into the cable 120. Each of these components is described in greater detail below.

As shown in FIG. 1C, the cable 120 may include four twisted pairs 125A, 125B, 125C, 102D; however, any other suitable number of pairs may be utilized. As desired, the twisted pairs 125A-D may be twisted or bundled together and/or suitable bindings may be wrapped around the twisted pairs 125A-D. For example, the twisted pairs 125A-D and the tape 100 may be helically twisted or bundled, together along a longitudinal direction of the cable 120. In other embodiments, multiple grouping of twisted pairs may be incorporated into a cable. As desired, each grouping may be twisted, bundled, and/or bound together. Further, in certain embodiments, the multiple groupings may be twisted, bundled, or bound together.

Each twisted pair (referred to generally as twisted pair 125) may include two electrical conductors, each covered with, suitable insulation. As desired, each of the twisted pairs 125A-D may have the same twist lay length or alternatively, at least two of the twisted pairs may include a different twist lay length. For example, each twisted pair may have a different twist rate. The different twist lay lengths may function to reduce crosstalk between the twisted pairs, A wide variety of suitable twist lay length configurations may be utilized. Additionally, in certain embodiments, each of the twisted pairs 125A-D may be twisted in the same direction (e.g., clockwise, counter clockwise). In other embodiments, at least two of the twisted pairs 125A-D may be twisted in opposite directions. Further, as desired in various embodiments, one or more of the twisted pairs 125A-D may be twisted in the same direction as an overall bunch lay of the combined twisted pairs 125A-D. For example, the conductors of each of the twisted pairs 125A-D may be twisted together in a given direction. The plurality of twisted pairs 125A-D may then be twisted together in the same direction as each of the individual pair's conductors. In other embodiments, at least one of the twisted pairs 125A-D may have a pair twist direction that is opposite that of the overall bunch lay. In yet other embodiments, all of the twisted pairs 125A-D may have pair twist directions that are opposite that of the overall bunch lay.

The electrical conductors of a twisted pair 125 may be formed from any suitable electrically conductive material, such as copper, aluminum, silver, annealed copper, gold, a conductive alloy, etc. Additionally, the electrical conductors may have any suitable diameter, gauge, and/or other dimensions. Further, each of the electrical conductors may be formed as either a solid conductor or as a conductor that includes a plurality of conductive strands that are twisted together. The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane. neoprene, choloro-sulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 125A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

Each twisted pair 125 can carry data or some other form of information, for example in a range of about one to ten Giga bits per second ("Gbps") or another appropriate frequency, whether faster or slower. In certain embodiments, each twisted pair 125 supports data transmission of about two and one-half Gbps (e.g. nominally two arid one-half Gbps), with the cable 120 supporting about ten Gbps (e.g. nominally ten Gbps). In certain embodiments, each twisted pair 125 supports data transmission of up to about ten Gbps (e.g. nominally ten Gbps), with the cable 120 supporting about forty Gbps (e.g. nominally forty Gbps).

The jacket 130 may enclose the internal components of the cable 120, seal the cable 120 from the environment, and provide strength and structural support. Similar to the twisted pair insulation, the jacket 130 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 130 may be formed as a single layer or, alternatively, as multiple layers. In certain embodiments, the jacket 130 may be formed from one or more layers of foamed material. Additionally, the jacket 130 may include a wide variety of suitable shapes (e.g., cross-sectional shape such as the illustrated round jacket) and/or dimensions (e.g., inner diameter, outer diameter, thickness, etc.). In various embodiments, the jacket 130 can be characterized as an outer jacket, an outer sheath, a casing, a circumferential cover, or a shell.

An opening enclosed by the jacket 130 may be referred to as a cable core, and the twisted pairs 125A-D, the tape 100, and other internal components may be disposed within the cable core. Although a single cable core is illustrated in FIG. 1C, a cable may be formed to include multiple cable cores. Other elements can be added to the cable core as desired, for example one or more optical fibers, additional electrical conductors, additional twisted pairs, water absorbing materials, and/or strength members, depending upon application goals.

In certain embodiments, one or more shield layers can be disposed between the jacket 130 and one or more additional cable components. For example, as shown in FIG. 1C, an external shield 135 or an overall shield may be disposed between the jacket 130 and the twisted pairs 125A-D. In other words, the external shield 135 may be wrapped around and/or encompass the collective group of twisted pairs 125A-D and the tape 100. In certain embodiments, the shield 135 may be positioned between the twisted pairs 125A-D and the outer jacket 130. In other embodiments, the shield 135 may be embedded into the outer jacket 130, incorporated into the outer jacket 130, or even positioned outside of the outer jacket 130. In other example embodiments, individual shields may be provided for each of the twisted pairs 125A-D. In yet other embodiments, shield layers may be provided for any desired groupings of twisted pairs. As desired, multiple shield layers may be provided, for example, individual shields and an overall shield. One or more shield layers may incorporate electrically conductive material, semi-conductive material, or dielectric shielding material in order to provide electrical shielding for one or more cable components. Further, in certain embodiments, the cable 120 may include a separate armor layer (e.g., a corrugated armor, etc.) for providing mechanical protection.

Various embodiments of the external shield 135 illustrated in FIG. 1C are generally described herein; however, it will be appreciated that other shield layers (e.g., individual shield layers, etc.) may have similar constructions. In certain embodiments, a shield 135 may be formed from a single segment or portion that extends along a longitudinal length of the cable 120. In other embodiments, a shield 135 may be formed from a plurality of discrete segments or portions positioned adjacent to one another along a longitudinal length of the cable 120. In the event that discrete segments or portions are utilized, in certain embodiments, gaps or spaces may exist between adjacent segments of portions. In other embodiments, certain segments may overlap one another. For example, an overlap may be formed between segments positioned adjacent to one another along a longitudinal length of the cable.

As desired, a wide variety of suitable techniques and/or processes may be utilized to form a shield 135 (or a shield segment). In certain embodiments, a foil shield or braided shield may be provided. In other embodiments, a shield 135 may be formed from a combination of dielectric material and shielding material. For example, a shield may be formed from a suitable tape structure similar to the tape 100 utilized as a separator. As desired, a shield 135 may include any number of suitable layers of dielectric and/or shielding material. Additionally, a shield 135 may be formed from a wide variety of suitable materials, such as those described above for the tape 100. Additionally, a shield 135 may be formed as a relatively continuous shield (e.g., a shield with a relatively continuous layer of electrically conductive material, shielding material, etc.) or a discontinuous shield having a plurality of isolated patches of shielding material. For a discontinuous shield, a plurality of patches of shielding material may be incorporated into the shield 135, and gaps or spaces may be present between adjacent patches in a longitudinal direction. A wide variety of different patch patterns may be formed as desired in various embodiments, and a patch pattern may include a period or definite step. In other embodiments, patches may be formed in a random or pseudo-random manner. Additionally, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

Similar to the tape 100, the components of a shield 135 (or segment of a shield) may include a wide variety of suitable dimensions, for example, any suitable lengths in the longitudinal direction, widths (i.e., a distance of the shield that will be wrapped around one or more twisted pairs 125A-D) and/or any suitable thicknesses. Additionally, a wide variety of segment and/or patch lengths (e.g., lengths along a longitudinal direction of the cable 120) may be utilized. As desired, the dimensions of the segments and/or patches can be selected to provide electromagnetic shielding over a specific band of electromagnetic frequencies or above or below a designated frequency threshold. For example, various shield 135 dimensions, patch dimensions, and/or patch shapes may be similar to those described above for the tape 100.

With continued reference to the cable 120 of FIG. 1C, the twisted tape 100 may be positioned between the plurality of twisted pairs 125A-D. Once twisted, various longitudinally spaced sections 105A-F may extend in different directions from a continuous portion 110 between different sets of adjacent twisted pairs. For example, as shown, a first section 105A may extend between a first twisted pair 125A and a fourth twisted pair 125D; a second section 105B may extend between the fourth twisted pair 125D and a third twisted pair 125C; a third section 105C may extend between the third twisted pair 1250 and a second twisted pair 125B; and a fourth section 105D may extend between the first twisted pair 125A and the second twisted pair 125B. A similar pattern may be repeated as desired along a longitudinal length of the cable 120.

As a result of incorporating the longitudinally twisted tape 100 into the cable 120 as a separator, desired spacing or separation may be provided between adjacent twisted pairs in order to reduce crosstalk. However, the resulting separator structure may be formed with less overall material than conventional separators, thereby reducing the overall cost of the cable. Indeed, an extruded cross-tiller separator may include substantially more material than the scored and twisted tape 100. Similar, a conventional tape separator that is folded over itself in multiple directions to form a cross-filler may use substantially more material. A scored and twisted tape separator may also provide enhanced flexibility relative to conventional separator structures.

Turning now to FIG. 1D, a cross-sectional view of another example twisted pair cable 150 that incorporated, a scored and twisted tape separator is illustrated. The cable 150 of FIG. 1D may include components that are similar to the cable 120 illustrated and described above with reference to FIG. 1C. Accordingly, the cable 150 may include a plurality of twisted pairs 155A-D disposed in a cable core, and the tape 100 may be twisted and positioned as a separator between the plurality of twisted pairs 155A-D. Additionally, a jacket 160 may be formed around the twisted pairs 155A-D.

However, in contrast to the cable 120 of FIG. 1C, one or more of the longitudinally spaced sections 105A-F of the tape 100 may extend from a continuous portion 110 between a desired set of twisted pairs and beyond an outer periphery or circumference defined by the collective group of twisted pairs 155A-D. In other words, the tape 100 may be formed with a suitable width that permits one or more, sections 105A-F to extend beyond an outer periphery of the twisted pairs 155A-D. As shown, each of the illustrated longitudinally spaced sections 105A-F may extend beyond an outer periphery of the twisted pairs 155A-D; however, in other embodiments, a first portion of the sections 105A-F may extend beyond the outer periphery while a second portion of the sections 105A-F do not extend beyond the outer periphery.

In certain embodiments, the portion of a longitudinally spaced section (generally referred to as section 105) that extends beyond an outer periphery of the twisted pairs 155A-D may be curled or wrapped around the outer periphery of the twisted pairs 155A-D. In this regard, the extending portion may form a wrap or shield layer around the outer periphery of the twisted pairs 155A-D. An extending portion may extend any desired distance beyond the outer periphery. As shown in FIG. 1D, each extending portion may extend a distance that is approximately one fourth of the outer circumference of the twisted pairs 155A-D. In other embodiments, one or more extending portions may extend any other suitable distance. As desired, an extending portion may overlap another extending portion (e.g., an adjacent extending portion in the event that the sections extend an non-perpendicular angles from a continuous section 110) or in some instances itself (e.g., if an extending portion extends all the way around the outer circumference). When an overlap is formed, an extending portion may be optionally adhered, bonded, mechanically fastened, or otherwise affixed to an underlying layer. As a result of including one or more portions that extend beyond an outer periphery of the twisted pairs 155A-D, the tape 100 may function as both a separator and as at least a partial outer shield layer.

As desired in various embodiments, a wide variety of other materials may be incorporated into a cable, such as one of the cables 120, 150 illustrated in FIGS. 1C and 1D. For example, as set forth above, a cable may include any number of conductors, twisted pairs, optical fibers, and/or other transmission media. As another example, one or more respective dielectric films or other suitable components may be positioned between the individual conductors of one or more of the twisted pairs. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), flame retardants, flame suppressants or extinguishants, gels, and/or other materials. The cables 120, 150 illustrated in FIGS. 1C and 1D are provided by way of example only. Embodiments of the disclosure contemplate a wide variety of other cables and cable constructions. These other cables may include more or less components than the cables 120, 150 illustrated in FIGS. 1C and 1D. Additionally, certain components may have different dimensions and/or materials than the components illustrated in FIGS. 1C and 1D. Further, a wide variety of different cable components may be formed to include ono or more cavities in which extinguishant may be positioned.

Example Tape Structures

The tape structure 100 illustrated in FIGS, 1A- 1D is one example tape structure that may be incorporated into a cable. A wide variety of other suitable tape structures or tapes may be utilized as desired in other embodiments of the disclosure. Additionally, various, tape structures may include a wide variety of dimensions, configurations, scoring configurations, layers, and/or materials. FIGS. 2A-2C illustrate a few example tape structures that may be utilized in accordance with various embodiments of the disclosure. FIGS. 3A-3E illustrate a few example scoring cutting configurations that may be utilized in association with any suitable tape structure. Finally, FIGS. 4A-4E illustrate a few example layer and/or material configurations that may be utilized in association with any suitable tape structure. Each of these figures is discussed in greater detail below.

Turning now to FIG. 2A, a top level view of an example tape 200 that may be scored and longitudinally twisted is illustrated. The tape 200 of FIG. 2A may be similar to the tape 100 of FIGS. 1A-1D. Accordingly, the tape 200 may include a plurality of longitudinally spaced sections 205A-F that are included in a tape portion that extends from a continuous portion 210 and that are defined by longitudinally spaced scoring or cutting. However, in contrast to the tape 100 illustrated in FIGS. 1A-1D, FIG. 2A illustrates a tape 200 in which one or more strength members or other strengthening arrangements are incorporated into the continuous portion 210.

A wide variety of suitable strength members may be incorporated into a continuous portion 210 as desired in various embodiments. Any number of strength members may be incorporated as desired. Examples of suitable strength members include, but are not limited to, aramid yarns, strength yarns, strength rods, etc. Additionally, a wide variety of suitable techniques may be utilized to incorporate a strength member into a continuous portion. For example, one or more strength members may be adhered, bonded, or mechanically fastened to a layer of the continuous portion. In other embodiments, one or more strength members be positioned between two layers of the continuous portion 110 and held in place based at least in part upon the attachment of the two layers to one another. In yet other embodiments, the continuous portion 210 may be strengthened as a function of being formed with a greater thickness than a portion of the tape 200 that includes the longitudinally spaced sections 205A-F. As a result of providing additional structural support for the continuous portion 210, the likelihood of the continuous portion 210 being torn, severed ripped, or otherwise damaged as a result of scoring, twisting, and/or otherwise processing the tape 200 may be reduced.

Figure 2B:
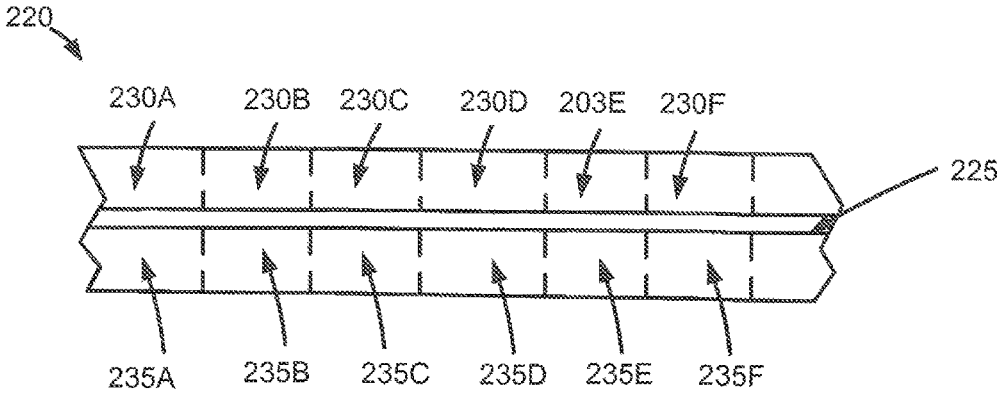
Figure 2C:
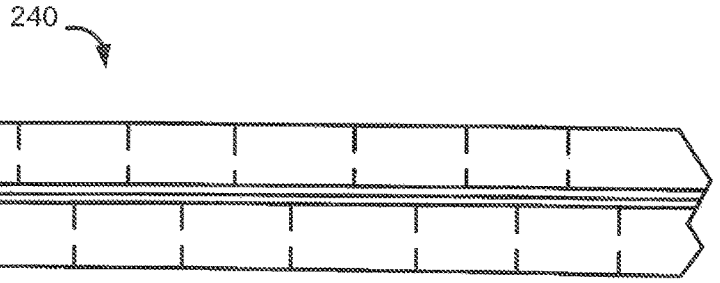

FIG. 2B illustrates a top level view of another example tape 220 that may be scored and longitudinally twisted in order to form a separator. By contrast to the tape 100 illustrated in FIGS. 1A-1D, the tape 220 may include a continuous portion 225 that is positioned between the two longitudinally extending widthwise edges of the tape 220. For example, as shown, the continuous portion 225 may be positioned approximately at a midpoint along the widthwise direction; however, in other embodiments, the continuous portion 225 may be offset from a widthwise midpoint line. A second portion of the tape 220 may extend between the continuous portion 225 and a first widthwise edge of the tape 220, and a first plurality of longitudinally spaced sections 230A-F may be formed by scoring the second portion between the first widthwise edge and the continuous portion 225. A third portion of the tape 220 may extend between the continuous portion 225 and a second widthwise edge opposite the first edge, and a second plurality of longitudinally spaced sections 235A-F may be formed by scoring the third portion between the second widthwise edge and the continuous portion 225.

A wide variety of suitable scoring configurations may be utilized in association with the tape 220. As shown, the second and third portions may be scored at spaced locations along the longitudinal length of the tape 220 that are approximately equal to one another. Accordingly, when the tape 220 is longitudinally twisted, corresponding spaced sections in the second and third portions may extend from the continuous portion 225 in directions that are parallel to one another (e.g., north and south, east and west, etc.). In other embodiments, as illustrated in the example tape 240 of FIG. 2C, at least one of the scores or cuts formed in a second portion of a tape 240 (i.e., a portion formed on one side of a continuous portion) may be longitudinally offset from proximate scores or cuts formed in a third portion of the tape 240 (i.e., a portion formed on an opposite side of the continuous portion). Indeed, a wide variety of suitable scoring and/or cutting arrangements may be utilized in association with a tape.

FIGS. 3A-3E are top level view of example scoring arrangements that may be utilized to form longitudinally spaced sections on a tape separator, such as any of the tapes described above with reference to FIGS. 1A-2C, according to illustrative embodiments of the disclosure. FIGS. 3A-3E illustrate a few example alternative scoring arrangements to those illustrated in FIGS. 1A-2C in which longitudinally spaced sections have approximately rectangular shapes. Each of the example scoring arrangement illustrated in FIGS. 3A-3E are shown in association with a tape in which a continuous portion is positioned proximate to a widthwise edge of the tape; however, it will be appreciated that similar scoring arrangements may be utilized in association with a wide variety of other tape configurations.

Figure 3A:
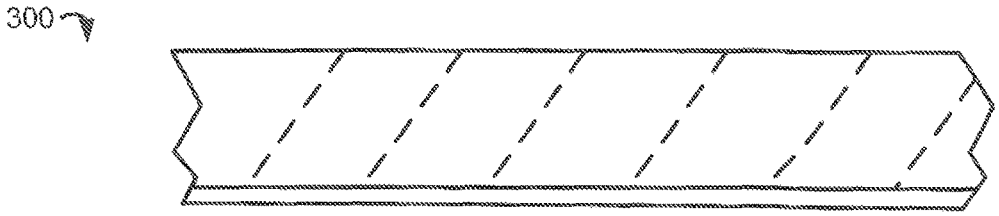
FIGS. 3A-3E are top level view of example scoring arrangements that may be utilized to form longitudinally spaced sections on a tape separator, according to illustrative embodiments of the disclosure.

Turning now to FIG. 3A, a first example tape 300 is illustrated. in which a scored portion of the tape 300 (e.g., a non-continuous portion of the tape) is scored at a plurality of longitudinal spaced locations with each respective scoring formed at an acute angle relative to the continuous portion. In this regard, a plurality of longitudinally spaced sections having approximately parallelogram shapes may be formed. In certain embodiments, the acute angles may permit sections of the tape to overlap with one another when incorporated into a cable. For example, if the longitudinally spaced sections extend beyond an outer periphery of the twisted pairs and are wrapped around the outer periphery, one or more of the sections may overlap in a longitudinal direction. A wide variety of suitable acute angles may be utilized as desired in various embodiments, such as angles of approximately 15, 20, 25, 30, 35, 40, 45, 50, 55, 60, 65, 70, or 75 degrees, an angle included in a range between two of the above values, or an angle included in a range bounded on either a minimum or maximum end by one of the above values.

Figure 3B:
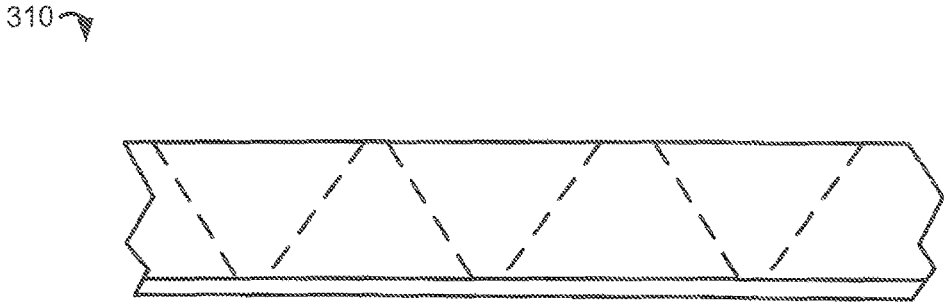
Figure 3C:
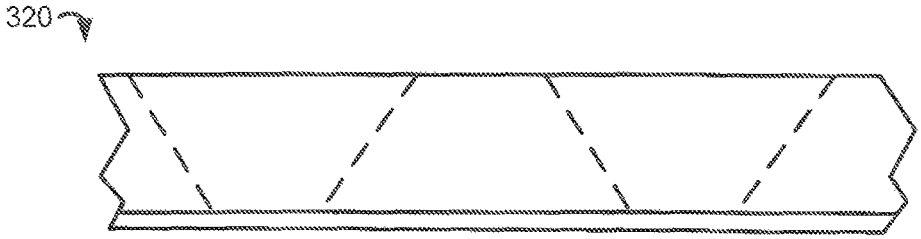
Figure 3D:
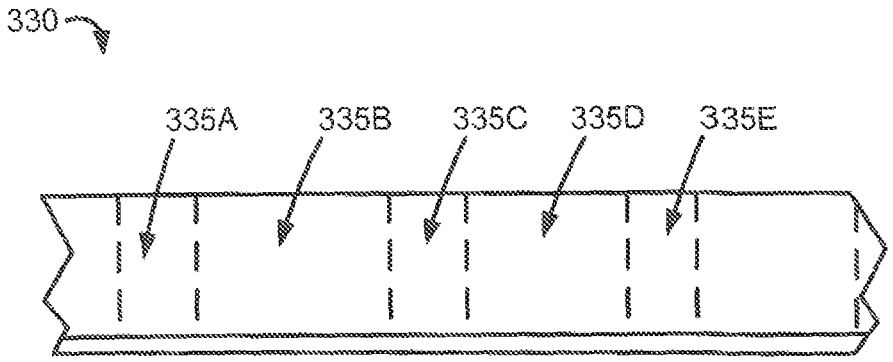
Figure 3E:
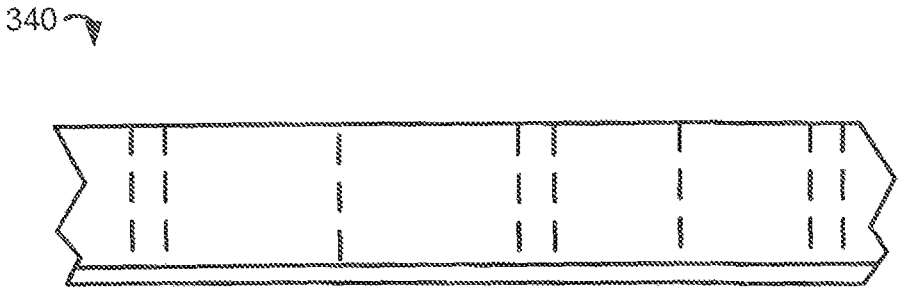

FIG. 3B illustrates an example tape 310 that is scored in order to form longitudinally spaced sections having approximately triangular shapes. As shown, the shapes may alternate between shapes having their base portion proximate to a continuous portion and shapes having a relatively short base (i.e., a portion that would be a point in the event that true triangular shapes are formed) proximate to the continuous portion. In other words, alternating sections may have shapes that are inverted relative to one another. FIG. 3C illustrates an example tape 320 that is scored in order to form longitudinally spaced sections having approximately trapezoidal shapes. Much like FIG. 3B, alternating sections may have shapes that are inverted relative to one another. Additionally, regardless of whether approximately triangular, trapezoidal, or other shapes are formed, the scoring lines may be formed at any desirables angles relative to the longitudinal direction.

Prior figures illustrate examples tapes in which longitudinally spaced sections are formed with approximately equal longitudinal lengths. In other embodiments, different sections may have different longitudinal lengths. FIG. 3C illustrates an example tape 320 having a plurality of longitudinally spaced sections 335A-E in which different sections have different longitudinal lengths. For example, a first group of sections 335A, 335C, 335E may have a first longitudinal length, and a second group of sections 335B, 335D may have a second longitudinal length different than the first longitudinal length. As shown in FIG. 3C, the lengths of the sections may alternate in accordance with a desired pattern. Additionally, any suitable pattern may be utilized, and longitudinally spaced sections may be formed with any desirable longitudinal length, shape, and/or other dimensions. In other embodiments, as illustrated by the example tape 340 of FIG. 3E, longitudinally spaced sections may be formed in a random or pseudorandom manner. For example, longitudinally spaced sections may be formed with random longitudinal lengths anchor other dimensions. Indeed, a wide variety, of suitable scoring arrangements may be utilized as desired, and those discussed herein are provided by way of non-limiting example only.

Figure 4A:
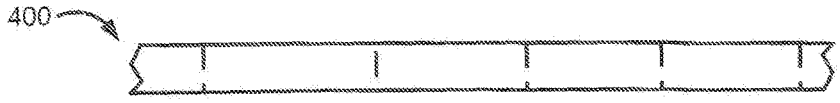
FIGS. 4A-4E are cross-sectional views of example layer constructions that may be utilized to form tape separators, according to illustrative embodiments of the disclosure.
Figure 4B:
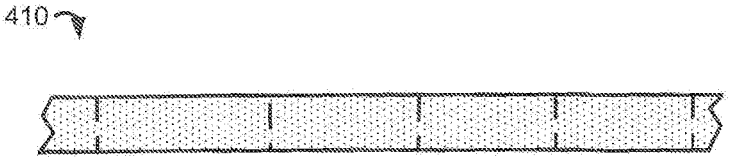

Additionally, as set forth above, a tape may be formed from a wide variety of suitable, materials and/or combinations of materials. A tape may also be, formed with any number of suitable layers. FIGS, 4A-4E are cross-sectional views of example layer constructions that may be utilized to form taps, such as any of the example tapes described above and/or illustrated in FIGS. 1A-3E. Turning first to FIG. 4A, a first example construction is illustrated in which a tape 400 is formed form a single layer of dielectric material. The tape 400 may then be scored at a plurality of longitudinally spaced locations. As discussed above with reference to FIG. 1A, a wide variety of suitable dielectric materials may be utilized. Similarly, a tape may be formed from a single layer of other materials. For example, as illustrated in FIG. 4B, a tape 410 may be formed from a single layer of semi-conductive material. As another example, a tape may be formed from a single layer of electrically conductive or other shielding material.

Figure 4C:
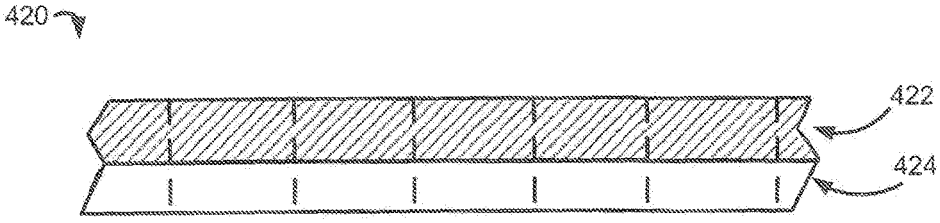
Figure 4D:
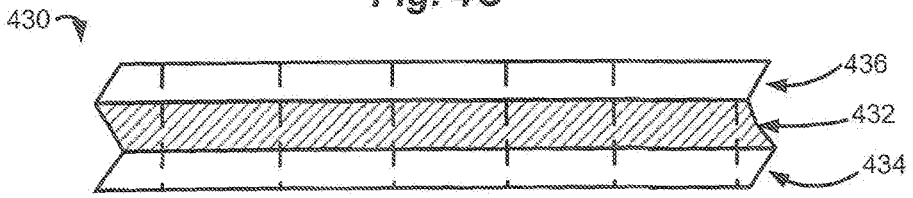
Figure 4E:
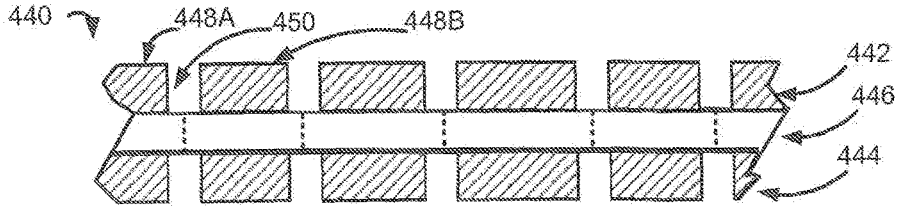

In other embodiments, a tape may be formed from a plurality of layers. For example, a tape may be formed from a combination of any number of dielectric, and/or shielding layers. FIG. 4C illustrates an example tape 420 that includes a shielding layer 422 formed on a dielectric layer 424. FIG. 4D illustrates an example tape 430 in which a shielding layer 432 is sandwiched between two layers of dielectric material 434, 436. FIG. 4E illustrates an example tape 440 in which respective layers of shielding material 442, 444 are formed on opposite sides or surfaces of a layer of dielectric material 446. Additionally, FIGS. 4C and 4D illustrate example tapes 420, 430 in which shielding layers are formed with relatively continuous longitudinal lengths. Discontinuous patches of shielding material may then be formed as desired by scoring and twisting the tapes 420, 430. By contrast, FIG. 4E illustrates an example tape 440 in which discontinuous patches of shielding material (e.g., patches 448A, 448B, etc.) are formed on the dielectric layer 446. In other words, suitable gaps or spaces (e.g., gap 450) may be present between adjacent patches. In certain embodiments, the gaps or spaces may correspond to one or more longitudinally spaced positions at which the tape 440 is scored. Indeed, a wide variety of suitable constructions may be utilized to form a tape. Those illustrated in FIGS. 4A-4E are provided by way of non-limiting example only.

Example Systems and Methods for Incorporating Tape Structures Into Cables

Figure 5:
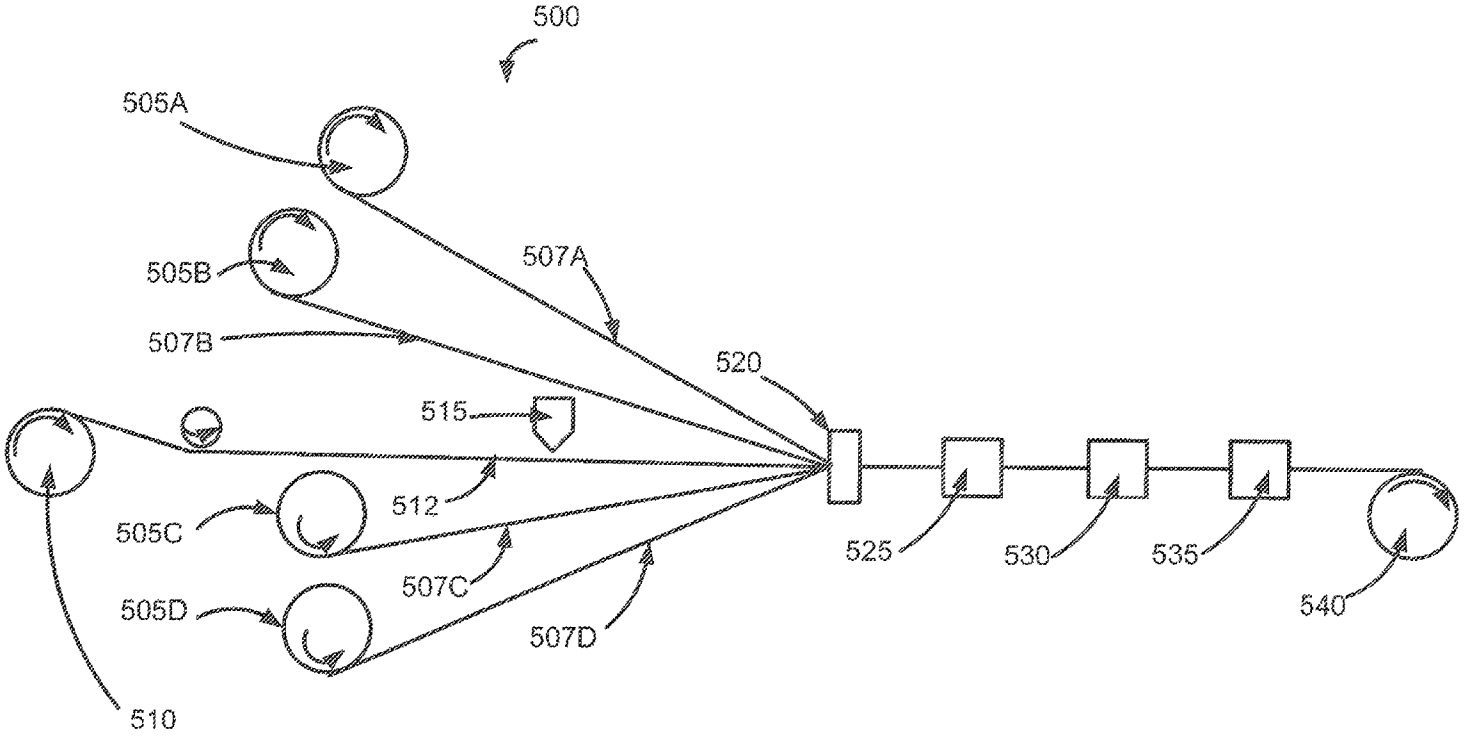
FIG. 5 is a block diagram of an example system that may be utilized to form a cable or cable component that incorporates a longitudinally twisted tape separator structure, according to an illustrative embodiment of the disclosure.

A wide variety of suitable systems and/or components may be utilized to form cables and/or cable components that incorporate longitudinally twisted tape structures. FIG. 5 is a block diagram of an example system 500 that may be utilized to form a cable or cable component incorporating a tape, according to an illustrative embodiment of the disclosure. The system 500 may incorporate a wide variety of suitable tapes, such as any of the example tapes illustrated and/or described with reference to FIGS. 1A-4E. Additionally, the system 500 may be utilized to form a wide variety of cables and/or cable components, such as the cables 120, 150 illustrated in FIGS. 1C and 1D.

With reference to the system 500, a plurality of sources 505A-D of twisted pairs 507A-D may be provided. In certain embodiments, the sources 505A-D may include payoffs, reels, bins, or other suitable components that may function to payout or otherwise provide twisted pairs 507A-D downstream to other components of the system 500. In other embodiments, one or more of the twisted pairs 507A-D may be provided in an in-line manner from one or more devices that manufacture and/or twist conductors together in order to form the twisted pairs 507A-D. Additionally, one or more sources 510 of a tape 512 may be provided. In certain embodiments, the source(s) 510 may include payoffs, reels, bins, or other suitable components that may function to payout or otherwise provide a tape 512 downstream to other components of the system 500. In other embodiments, a tape 512 may be provided in an in-line manner from one or more devices that manufacture or assembly the tape 512 (e.g., devices that combine dielectric and shielding layers, etc.).

The tape 512 may be provided to one or more suitable scoring and/or cutting devices 515 that are configured to score or cut the tape 512 in order to form any number of desired longitudinally spaced sections that extend from a longitudinally continuous portion. As set forth in greater detail above, a wide variety of suitable devices and/or combinations of devices 515 may be utilized to score the tape 512 including, but not limited to, knives, cutting blades, other mechanical cutting tools, lasers, chemical etching devices, etc. In certain embodiments, scoring or cuts may be made completely through the tape 512. In other embodiments, scorings or cuts may be made partially through the tape 512.

The twisted pairs 507A-D and the tape 512 may be fed to a suitable accumulation point 520, and the tape 512 may be positioned between the plurality of twisted pairs 507A-D. Additionally, one or more suitable twisting devices 525 may be configured to longitudinally twist the tape 512 (e.g., longitudinally twist the tape 512 via twisting the continuous portion) prior to the tape 512 being positioned proximate to the twisted pairs 507A-D. A wide variety of suitable twisting devices 525 may be utilized as desired, such as a twisting device that is connected to the tape 512 and that twist the tape in either a clockwise or counter-clockwise direction. In certain embodiments, back tension supplied by the source 510 and/or other devices may work in conjunction with the twisting device(s) to longitudinally twist the tape 512. Additionally, as a result of longitudinally twisting the tape 512, the longitudinally spaced sections may separate from one another at adjacent scoring or cutting locations, and the longitudinally spaced sections may extend from a continuous section in a plurality of different direction. Accordingly, when the tape 512 is brought into proximity with the twisted pairs 507A-D, various spaced sections may extend between different sets of adjacent twisted pairs.

The twisting device(s) 525 may be configured to twist the tape 512 at any suitable rate and/or to achieve any desirable twist lay. Additionally, in certain embodiments, the twisting device(s) 525 may be synchronized with the feed rates of the twisted pairs 507A-D and/or the tape 512 via any number of suitable computing and/or control devices. In certain embodiments, the synchronization may facilitate the proper positioning of the tape 512 between the twisted pairs 507A-D such that various longitudinally spaced sections extend in appropriate directions.

In certain embodiments, following the positioning of the tape 512 between the twisted pairs 507A-D, any portions of the tape 512 that extend beyond an outer periphery of the twisted pairs 507A-D may be wrapped or curled around the outer periphery and optionally bonded to an underlying layer. Additionally, the twisted pairs 507A-D and the tape 512 may be helically stranded or twisted together via any number of suitable twisting devices 530. In other words, an overall lay or twist may be imparted on the colletive plurality of the twisted pairs 507A-D and the tape 512. A wide variety of suitable devices may be utilized to accumulate and twist the twisted pairs 507A-D including, but not limited to, bunching devices (e.g., bunching dies, etc.), stranding devices (e.g., stranding dies etc.), and/or cabling devices.

With continued reference to FIG. 5, one or more suitable devices may be utilized to form an outer wrap around the twisted pairs 507A-D and the tape 512. For example, one or more suitable extrusion devices 535 may be utilized to extrude a jacket around the twisted pairs 507A-D and the tape 512. As another example, one or more suitable dies and/or wrapping devices may be utilized to form a shield or other suitable layer around the twisted pairs 507A-D and the tape 512. In the event that a shield or other wrap is formed, a jacket may subsequently be formed as desired in certain embodiments.

Once a cable or cable core (e.g., a cable structure with no outer jacket, etc.) has been constructed, one or more suitable take-up devices 540 may be utilized to collect the cable. For example, the cable may be spooled onto one or more suitable reels or collected into suitable packaging (e.g., boxes, shrink wrap, etc.). In other embodiments, the cable may be provided to any number of suitable downstream devices, such as one or more systems or components that incorporate the cable or cable core into a larger structure, such as a composite cable.

The system 500 discussed above with reference to FIG. 5 is provided by way of example only. A wide variety of other suitable systems may include more or less than the components illustrated in FIG. 5. Additionally, any suitable arrangements and/or ordering of components may be utilized in order to facilitate desired application goals and/or cable constructions.

Figure 6:
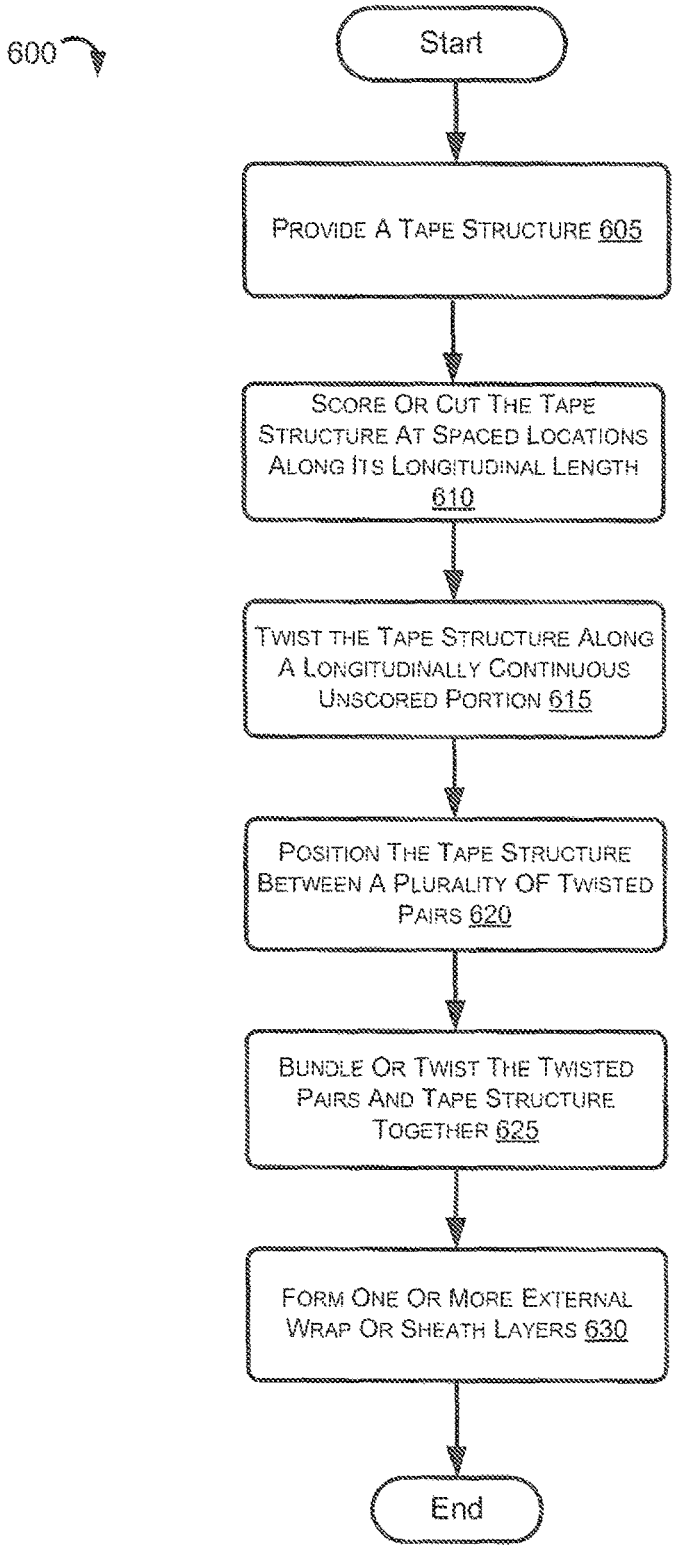
FIG. 6 is a flow chart of an example method for incorporating a longitudinally twisted tape separator structure into a cable, according to an illustrative embodiment of the disclosure.

FIG. 6 is a flow chart of an example method 600 for incorporating a longitudinally twisted tape separator structure into a cable, according to an illustrative embodiment of the disclosure. The method 600 may be carried out. utilizing a wide variety of suitable systems and/or components, such as the system 500 illustrated in FIG. 5. The method 600 may begin at block 605. At block 605, a tape structure or tape may be provided. The tape may include any number of layers and may be formed from any number of suitable materials. For example, the tape may be any of the tapes described above.

At block 610, the tape may be scored or cut at a plurality of spaced locations along its longitudinal length. According to an aspect of the disclosure, the tape may include a continuous portion that extends along its longitudinal length, and the tape may be scored in one or inure other portions that extend from the continuous portion. For example, the tape may be scored at a plurality of respective locations between a longitudinally extending widthwise edge and the continuous portion. Additionally, as described above, the tape may be scored in accordance with a wide variety of suitable patterns and/or configurations. As a result of scoring the tape, a plurality of longitudinally spaced sections that extend from the continuous portion may be defined. These spaced sections may have a wide variety of suitable lengths, shapes, and/or other dimensions.

At block 615, the tape may be longitudinal twisted, for example, by utilizing one or more suitable twisting devices to twist the continuous portion of the tape. As a result of longitudinally twisting the tape, the longitudinally spaced sections may extend from the continuous portion in a plurality of different directions. For example, prior to twisting, the tape may occupy a single plane. However, in certain embodiments once the tape is twisted, various sections may extend in different directions such that the tape may function as a cross-shaped separator. In other words, respective sections may extend between each set of adjacent twisted pairs.

At block 620, a a plurality of twisted pairs of individually insulated conductors, such as the conductors 105A-D illustrated in FIG. 1, may be provided, and the tape may be positioned between the twisted pairs. As set forth above, when the tape is positioned between the twisted pairs, different spaced sections may extend between different sets of twisted pairs. At block 625, the twisted pairs and the tape may be helically twisted and/or bunched together. In other words, an overall twist lay or bunch lay may be applied to the collective plurality of twisted pairs and the tape. One or more suitable sheath layers, such as a shield layer, outer jacket, or other external wrap may then be formed around the twisted pairs and the tape at block 630. One or more finishing operations, such as take-up of the cable or provision of the cable to one or more downstream devices, may then occur. The method 600 may end following block 630.

As desired in various embodiments, the method 600 may include more or less operations than those described above with reference to FIG. 6. For example, portions of a tape that extend beyond an outer periphery of the twisted pairs may be wrapped or curled around the outer periphery, Additionally, in certain embodiments, any number of the described operations may be carried out or performed in parallel. The described method 600 is provided by way of non-limiting example only.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a genetic and descriptive sense only and not for purposes of limitation.

That which is claimed:

1. A cable comprising:

a plurality of twisted pairs of individually insulated electrical conductors that extend along a longitudinal direction;

a tape separator positioned between the twisted pairs, the tape separator comprising:

a first portion that is continuous and twisted along the longitudinal direction; and a second portion that is severed at a plurality of respective spaced locations along the longitudinal direction from a longitudinally extending edge of the tape separator to the first portion in order to define a plurality of longitudinally spaced sections;

wherein longitudinally adjacent sections included in the plurality of longitudinally spaced sections of the second portion extend from the first portion in different directions between different sets of adjacent twisted pairs included in the plurality of twisted pairs;

wherein, along a longitudinal length of the tape separator, the second portion extends between each set of adjacent twisted pairs included in the plurality of twisted pairs, and wherein, at any given cross-sectional location along the longitudinal length of the tape separator, the second portion does not extend between each set of adjacent twisted pairs included in the plurality of twisted pairs; and a jacket formed around the twisted pairs and the tape separator.

2. The cable of claim 1, wherein the tape separator comprises a substantially flat separator prior to the first portion being twisted.

3. The cable of claim 1, wherein the longitudinally extending edge comprises a first longitudinally extending edge and the first portion is positioned proximate to a second longitudinally extending edge opposite the first edge.

4. The cable of claim 1, wherein the second portion is severed at a plurality of respective spaced locations in a direction perpendicular to the longitudinal direction.

5. The cable of claim 1, wherein the second portion is severed at a plurality of respective-spaced locations in accordance with a repeating pattern.

6. The cable of claim 1, wherein each of the plurality of longitudinally spaced sections comprises one of a rectangular, parallelogram, approximately triangular, or trapezoidal shape.

7. The cable of claim 1, wherein each of the plurality of longitudinally spaced sections has an approximately equal length in the longitudinal direction.

8. The cable of claim 1, wherein the tape separator comprises electromagnetic shielding material.

9. The cable of claim 1, wherein the tape separator comprises at least one dielectric layer and at least one layer of electromagnetic shielding material.

10. A cable comprising:

a plurality of twisted pairs of individually insulated electrical conductors that extend along a longitudinal direction;

a tape separator positioned between the twisted pairs, the tape separator comprising:

a longitudinally continuous portion that is twisted along its longitudinally length; and a plurality of longitudinally spaced sections extending from the continuous portion and defined by severing the separator at a plurality of spaced locations from an edge to the continuous portion, wherein the plurality of longitudinally spaced sections extend from the continuous portion in alternating directions along the longitudinal length, each longitudinally adjacent pair of spaced sections extending between different sets of adjacent twisted pairs included in the plurality of twisted pairs;

wherein, along a longitudinal length of the tape separator, the plurality of longitudinally spaced sections extend between each set of adjacent twisted pairs included in the plurality of twisted pairs, and wherein, at any given cross-sectional location along the longitudinal length of the tape separator, the plurality of longitudinally spaced sections only extend between one or two sets of adjacent twisted pairs included in the plurality of twisted pairs; and a jacket formed around the twisted pairs and the separator.

11. The cable of claim 10, wherein the edge comprises a first longitudinally extending edge and the continuous portion is positioned proximate to a second longitudinally extending edge opposite the first edge.

12. The cable of claim 10, wherein the separator is severed at the plurality of spaced locations in a direction perpendicular to the longitudinal direction.

13. The cable of claim 10, wherein the separator is severed at the plurality of spaced locations in accordance with a repeating pattern.

14. The cable of claim 10, wherein each of the plurality of longitudinally spaced sections comprises one of a rectangular, parallelogram, approximately triangular, or trapezoidal shape.

15. The cable of claim 10, wherein each of the plurality of longitudinally spaced sections has an approximately equal length in the longitudinal direction.

16. The cable of claim 10, wherein the separator comprises electromagnetic shielding material.

* * * * *